US006887102B1

(12) United States Patent
Burris et al.

(10) Patent No.: US 6,887,102 B1
(45) Date of Patent: May 3, 2005

(54) COAXIAL CABLE CONNECTOR AND NUT MEMBER

(75) Inventors: Donald A. Burris, Peoria, AZ (US); William B. Lutz, Glendale, AZ (US); Kenneth S. Wood, Elmira, NY (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 10/823,333

(22) Filed: Apr. 13, 2004

(51) Int. Cl.[7] ..... H01R 9/05
(52) U.S. Cl. ..... 439/578
(58) Field of Search ..... 439/578, 579–585, 439/879, 675, 63

(56) References Cited

U.S. PATENT DOCUMENTS

| | | | | |
|---|---|---|---|---|
| 522,144 | A | | 6/1894 | Boyer |
| 989,294 | A | | 4/1911 | Sackrider |
| 3,198,230 | A | | 8/1965 | Stover, III ..... 151/21 |
| 3,342,233 | A | | 9/1967 | Meisel ..... 151/21 |
| 3,511,118 | A | | 5/1970 | Mitchell ..... 81/119 |
| 3,512,447 | A | | 5/1970 | Vaughn ..... 85/61 |
| 3,641,848 | A | | 2/1972 | Franks ..... 81/121 |
| 4,043,369 | A | | 8/1977 | Abernethy ..... 151/21 |
| 4,457,469 | A | | 7/1984 | Ratchford |
| 4,457,572 | A | | 7/1984 | Frazier et al. |
| 4,462,652 | A | | 7/1984 | Werth et al. |
| 4,478,473 | A | | 10/1984 | Frear |
| 4,478,474 | A | | 10/1984 | Gallusser et al. |
| 4,479,689 | A | | 10/1984 | Marmillion et al. |
| 4,741,702 | A | * | 5/1988 | Yasumoto ..... 439/13 |
| D296,579 | S | | 7/1988 | Hattori ..... D23/262 |
| 4,877,271 | A | | 10/1989 | McCorkle et al. ..... 285/39 |
| 5,049,017 | A | | 9/1991 | Reynolds ..... 411/432 |
| 6,109,963 | A | * | 8/2000 | Follingstad et al. ..... 439/578 |
| 6,409,444 | B2 | | 6/2002 | Pamer et al. ..... 411/180 |
| 2003/0162439 | A1 | * | 8/2003 | Rodrigues et al. ..... 439/578 |
| 2003/0224657 | A1 | * | 12/2003 | Malloy ..... 439/578 |
| 2004/0048514 | A1 | * | 3/2004 | Kodaira ..... 439/578 |
| 2004/0077215 | A1 | * | 4/2004 | Palinkas et al. ..... 439/578 |

OTHER PUBLICATIONS

*Connector Catalogue 1, Edition E*, Spinner GmbH, Electrotechnische Fabrik, Erzglessereistrasse 33, D–80335 Müchen, Mar. 2002, pps. front, 19–29, 30–41, 49–51 and back.

* cited by examiner

*Primary Examiner*—J. F. Duverne
(74) *Attorney, Agent, or Firm*—Joseph M. Homa

(57) ABSTRACT

A nut member for a coaxial cable connector is disclosed herein which is capable of being tightened by hand or by a tool. A connector incorporating the nut member is also disclosed. The combination of a connector incorporating the nut member and a tool for tightening the connector onto a terminal is also disclosed.

31 Claims, 14 Drawing Sheets

COAXIAL CABLE CONNECTOR AND NUT MEMBER

BACKGROUND OF THE INVENTION

1. Field of the Invention

The present invention relates generally to coaxial cable connectors, and particularly to coaxial cable connectors capable of being connected to a terminal.

2. Technical Background

Coaxial cable connectors such as F-connectors are used to attach coaxial cable to another object such as an appliance or junction having a terminal adapted to engage the connector. A suitably tight connection between a connector and a terminal is typically achieved by using a tool such as a wrench for applying enough torque to the connector. A suitable connection tends to reduce signal leakage and improve signal or picture quality. Typically, use of a tool is acceptable, even encouraged or mandated, in some scenarios, such as when establishing a connection with a terminal located outdoors, on a utility pole and the like. However, tightening, or over-tightening, of connectors to an indoor appliance, such as a television or other electronic equipment, by a tool has in some cases led to the appliance being damaged. Tightening of the connectors in indoor applications is preferably done by hand, i.e. by finger- or hand-tightening. Thus, the installer may need to tighten the same type of connector via tool or via hand, depending on the scenario. However, an adequate grip on the connector to establish satisfactorily tight connection is often not available. Some known connectors utilize a circular cylindrical outer surface provided with knurling to improve grip while hand tightening, but such connectors are not typically suitable for tightening by a tool and the knurling can add considerable cost to the connector.

SUMMARY OF THE INVENTION

The present invention allows coaxial connector tightening via tool, or via hand, or both.

A nut member for a coaxial cable connector is disclosed herein, the nut member comprising a nut body having a central longitudinal axis and a central hole. The nut body comprises: a driving head portion having a rear end, a front end, an outer side surface, and an inner side surface extending from the rear end to the front end, the inner side surface defining at least part of the central hole, the outer side surface comprising a plurality of oppositely disposed flat sides disposed substantially parallel, preferably parallel, with the central longitudinal axis, wherein each of the flat sides lies in a respective plane disposed at least a minimum radial distance $R_F$ from the central longitudinal axis, wherein the planes of respective adjacent flat sides intersect along respective apex lines, preferably parallel with the central longitudinal axis, disposed at a radial distance $R_X$ from the central longitudinal axis, wherein adjacent flat sides intersect along corner edges disposed at a maximum radial distance $R_C$ from the central longitudinal axis, wherein $(R_C-R_F)/(R_X-R_F)>0.75$; and, an annular portion having a rear end disposed at the front end of the driving head portion, a front end, an outer side surface having a maximum radius less than $R_F$ such that a minimum radial offset is provided between the outer side surface of the driving head portion and the outer side surface of the annular portion, and an inner side surface extending from the rear end of the annular portion to the front end of the annular portion, the inner side surface of the annular portion defining at least part of the central hole; wherein at least one of the inner side surface of the driving head portion and the inner side surface of the annular portion has threads; wherein at least two of the flat sides are grooved with at least one longitudinal groove intermediate adjacent corner edges, each of the grooves having a respective maximum width, $w_i$, and a respective maximum depth, wherein each grooved flat side has a respective total groove width $\Sigma w_i$, wherein the respective maximum depth of each of the grooves is not greater than the radial offset between the outer side surfaces of the driving head portion and the annular portion, that is, for any angular position in a transverse plane that intersects a respective groove.

Preferably, none of the grooves extend to the inner side surface of the driving head portion.

In one preferred embodiment, the inner side surface of the driving head portion has threads. In another preferred embodiment, the inner side surface of the annular portion has threads. In yet another preferred embodiment, the inner side surfaces of the driving head portion and the inner side surface of the annular portion have threads.

In preferred embodiments, the central hole has varying diameter. In some preferred embodiments, the inner side surface of the driving head portion comprises a flange the central hole.

Preferably, none of the grooves has a maximum depth greater than the minimum radial offset between the outer side surfaces of the driving head portion and the annular portion.

In preferred embodiments, the grooved flat sides have a longitudinal groove disposed between adjacent corner edges and closer to the corner edge in the direction of the threads.

In preferred embodiments, the grooved flat sides have a longitudinal groove disposed between adjacent corner edges and closer to the corner edge upon which torque is applied when tightening the nut.

Preferably, each grooved flat side has a transverse width $W_F$ and a total groove width, and the ratio $\Sigma w_i/W_F$ is greater than 0.05, more preferably greater than 0.10, even more preferably greater than 0.15, for each of the grooved flat sides.

In preferred embodiments, each grooved flat side has a transverse width $W_F$ and a total groove width, and the ratio $\Sigma w_i/W_F$ is between 0.05 and 1.0 for each of the grooved flat sides.

In other preferred embodiments, each grooved flat side has a transverse width $W_F$ and a total groove width, and the ratio $\Sigma w_i/W_F$ is between 0.10 and 0.9 for each of the grooved flat sides.

In other preferred embodiments, each grooved flat side has a transverse width $W_F$ and a total groove width, and the ratio $\Sigma w_i/W_F$ is between 0.15 and 0.8 for each of the grooved flat sides.

Preferably, none of the grooves has a maximum depth greater than the difference between the minimum radial distance $R_F$ from the central longitudinal axis and the maximum radius of the outer side surface of the annular portion.

Preferably, the flats have a transverse width $W_F$, and all of the grooves are spaced away from the corner edges by at least 0.10 $W_F$. More preferably, the flats have a transverse width $W_F$, and all of the grooves are spaced away from the corner edges by at least 0.12 $W_F$. Even more preferably, the flats have a transverse width $W_F$, and all of the grooves are spaced away from the corner edges by at least 0.14 $W_F$.

Preferably, a majority of the flat sides are grooved with at least one longitudinal groove. In preferred embodiments, all of the flat sides are grooved with at least one longitudinal groove. In other preferred embodiments, all of the flat sides are grooved with at least two longitudinal grooves.

Preferably, the grooves extend from the rear end to the front end of the driving head portion. More preferably, the grooves extend continuously from the rear end to the front end of the driving head portion.

Preferably, none of the longitudinal grooves extend onto the outer side surface of the annular portion. Preferably, the outer side surface of the annular portion has no longitudinal grooves.

Preferably the central hole extends through the nut member from end to end, and preferably the central hole is centered about the central longitudinal axis.

In one set of preferred embodiments, a nut member for a coaxial cable connector is disclosed herein, the nut member comprising a nut body having a central longitudinal axis and a central hole, the nut body comprising: a driving head portion having a rear end, a front end, an outer side surface, and an inner side surface extending from the rear end to the front end, the inner side surface defining at least part of the central hole, the outer side surface comprising a plurality of oppositely disposed flat sides disposed substantially parallel, preferably parallel, with the central longitudinal axis, wherein each of the flat sides lies in a respective plane disposed at least a minimum radial distance $R_F$ from the central longitudinal axis, wherein the planes of respective adjacent flat sides intersect along respective apex lines, preferably parallel with the central longitudinal axis, disposed at a radial distance $R_X$ from the central longitudinal axis, wherein adjacent flat sides intersect along corner edges disposed at a maximum radial distance $R_C$ from the central longitudinal axis, wherein $(R_C-R_F)/(R_X-R_F)>0.75$; and an annular portion having a rear end disposed at the front end of the driving head portion, a front end, an outer side surface having a maximum radius less than $R_F$ such that a minimum radial offset is provided between the outer side surface of the driving head portion and the outer side surface of the annular portion, and an inner side surface extending from the rear end of the annular portion to the front end of the annular portion, the inner side surface of the annular portion defining at least part of the central hole; wherein at least one of the inner side surface of the driving head portion and the inner side surface of the annular portion has threads; and wherein each of the flat sides is grooved with at least one longitudinal groove intermediate adjacent corner edges, each of the grooves having a respective maximum width, $w_i$, and a respective maximum depth, wherein each grooved flat side has a respective total groove width $\Sigma w_i$, wherein the respective maximum depth of each of the grooves is not greater than the radial offset between the outer side surfaces of the driving head portion and the annular portion. Preferably, each of the flat sides is grooved with at least two longitudinal grooves. Preferably, none of the grooves extend to the inner side surface of the driving head portion.

In one preferred embodiment, the inner side surface of the driving head portion has threads. In another preferred embodiment, the inner side surface of the annular portion has threads. In yet another preferred embodiment, the inner side surfaces of the driving head portion and the inner side surface of the annular portion have threads.

In preferred embodiments, the central hole has varying diameter. In some preferred embodiments, the inner side surface of the driving head portion comprises a flange the central hole.

Preferably, none of the grooves has a maximum depth greater than the minimum radial offset between the outer side surfaces of the driving head portion and the annular portion.

In preferred embodiments, the grooved flat sides have a longitudinal groove disposed between adjacent corner edges and closer to the corner edge in the direction of the threads.

In preferred embodiments, the grooved flat sides have a longitudinal groove disposed between adjacent corner edges and closer to the corner edge upon which torque is applied when tightening the nut.

Preferably, each grooved flat side has a transverse width $W_F$ and a total groove width, and the ratio $\Sigma w_i/W_F$ is greater than 0.05, more preferably greater than 0.10, even more preferably greater than 0.15, for each of the grooved flat sides.

In preferred embodiments, each grooved flat side has a transverse width $W_F$ and a total groove width, and the ratio $\Sigma w_i/W_F$ is between 0.05 and 1.0 for each of the grooved flat sides.

In other preferred embodiments, each grooved flat side has a transverse width $W_F$ and a total groove width, and the ratio $\Sigma w_i/W_F$ is between 0.10 and 0.9 for each of the grooved flat sides.

In other preferred embodiments, each grooved flat side has a transverse width $W_F$ and a total groove width, and the ratio $\Sigma w_i/W_F$ is between 0.15 and 0.8 for each of the grooved flat sides.

Preferably, none of the grooves has a maximum depth greater than the difference between the minimum radial distance $R_F$ from the central longitudinal axis and the maximum radius of the outer side surface of the annular portion.

Preferably, the flats have a transverse width $W_F$, and all of the grooves are spaced away from the corner edges by at least 0.10 $W_F$. More preferably, the flats have a transverse width $W_F$, and all of the grooves are spaced away from the corner edges by at least 0.12 $W_F$. Even more preferably, the flats have a transverse width $W_F$, and all of the grooves are spaced away from the corner edges by at least 0.14 $W_F$.

In some preferred embodiments, all of the flat sides are grooved with at least two longitudinal grooves.

Preferably, the grooves extend from the rear end to the front end of the driving head portion. More preferably, the grooves extend continuously from the rear end to the front end of the driving head portion.

Preferably, none of the longitudinal grooves extend onto the outer side surface of the annular portion. Preferably, the outer side surface of the annular portion has no longitudinal grooves.

Preferably the central hole extends through the nut member from end to end, and preferably the central hole is centered about the central longitudinal axis.

A connector for coupling an end of a coaxial cable to a threaded terminal is disclosed herein, the connector comprising: a cylindrical body member having a rear end adapted to receive the end of the coaxial cable, a front end, and a central hole extending through the cylindrical body from the rear end to the front end; a nut member having a central hole extending through the nut member, wherein the nut member engages the front end of the cylindrical body member; and a post member comprising a post flange and a post shank, the post member disposed at least partially within the central hole of the cylindrical body member at the front end of the cylindrical body member and disposed at least partially within the central hole of the nut member, wherein the post member and the cylindrical body member are movable with respect to each other in a cable-insertion position, wherein the post member and the cylindrical body member are adapted to sandwich a part of the coaxial cable in a cable-installed position; wherein the nut member comprises a nut body having a central longitudinal axis, the nut body comprising: a driving head portion having a rear end, a front end, an outer side surface, and an inner side surface extending from the rear end to the front end, the inner side surface defining at least part of the central hole of the nut member, the inner side surface comprising an annular collar for rotatably engaging the front end of the cylindrical body member, the outer side surface comprising a plurality of oppositely disposed flat sides disposed substantially parallel, preferably parallel, with the central longitudinal axis, wherein each of the flat sides lies in a respective plane disposed at least a minimum radial distance $R_F$ from the central longitudinal axis, wherein the planes of respective adjacent flat sides intersect along respective apex lines, preferably parallel with the central longitudinal axis, disposed at a maximum radial distance $R_X$ from the central longitudinal axis, wherein adjacent flat sides intersect along corner edges disposed at a maximum radial distance $R_C$ from the central longitudinal axis, wherein $(R_C-R_F)/(R_X-R_F)>0.75$; and an annular portion having a rear end disposed at the front end of the driving head portion, a front end, an outer side surface having a maximum radius less than $R_F$ such that a minimum radial offset is provided between the outer side surface of the driving head portion and the outer side surface of the annular portion, and an inner side surface extending from the rear end of the annular portion to the front end of the annular portion, the inner-side surface of the annular portion defining at least part of the central hole; wherein at least one of the inner side surface of the driving head portion and the inner side surface of the annular portion has threads adapted to threadably engage the threaded terminal; wherein at least two of the flat sides are grooved with at least one longitudinal groove intermediate adjacent corner edges, each of the grooves having a respective maximum width, $w_i$, and a respective maximum depth, wherein each grooved flat side has a respective total groove width $\Sigma w_i$, wherein the respective maximum depth of each of the grooves is not greater than the radial offset between the outer side surfaces of the driving head portion and the annular portion.

Preferably, none of the grooves extend to the inner side surface of the driving head portion.

In one preferred embodiment, the inner side surface of the driving head portion has threads. In another preferred embodiment, the inner side surface of the annular portion has threads. In yet another preferred embodiment, the inner side surfaces of the driving head portion and the inner side surface of the annular portion have threads.

In preferred embodiments, the central hole has varying diameter. In some preferred embodiments, the inner side surface of the driving head portion comprises a flange.

Preferably, none of the grooves has a maximum depth greater than the minimum radial offset between the outer side surfaces of the driving head portion and the annular portion.

In preferred embodiments, the grooved flat sides have a longitudinal groove disposed between adjacent corner edges and closer to the corner edge in the direction of the threads.

In preferred embodiments, the grooved flat sides have a longitudinal groove disposed between adjacent corner edges and closer to the corner edge upon which torque is applied when tightening the nut.

Preferably, each grooved flat side has a transverse width $W_F$ and a total groove width, and the ratio $\Sigma w_i/W_F$ is greater than 0.05, more preferably greater than 0.10, even more preferably greater than 0.15, for each of the grooved flat sides.

In preferred embodiments, each grooved flat side has a transverse width $W_F$ and a total groove width, and the ratio $\Sigma w_i/W_F$ is between 0.05 and 1.0 for each of the grooved flat sides.

In other preferred embodiments, each grooved flat side has a transverse width $W_F$ and a total groove width, and the ratio $\Sigma w_i/W_F$ is between 0.10 and 0.9 for each of the grooved flat sides.

In other preferred embodiments, each grooved flat side has a transverse width $W_F$ and a total groove width, and the ratio $\Sigma w_i/W_F$ is between 0.15 and 0.8 for each of the grooved flat sides.

Preferably, none of the grooves has a maximum depth greater than the difference between the minimum radial distance $R_F$ from the central longitudinal axis and the maximum radius of the outer side surface of the annular portion.

Preferably, the flats have a transverse width $W_F$, and all of the grooves are spaced away from the corner edges by at least 0.10 $W_F$. More preferably, the flats have a transverse width $W_F$, and all of the grooves are spaced away from the corner edges by at least 0.12 $W_F$. Even more preferably, the flats have a transverse width $W_F$, and all of the grooves are spaced away from the corner edges by at least 0.14 $W_F$.

Preferably, a majority of the flat sides are grooved with at least one longitudinal groove. In preferred embodiments, all of the flat sides are grooved with at least one longitudinal groove. In other preferred embodiments, all of the flat sides are grooved with at least two longitudinal grooves.

Preferably, the grooves extend from the rear end to the front end of the driving head portion. More preferably, the grooves extend continuously from the rear end to the front end of the driving head portion.

Preferably, none of the longitudinal grooves extend onto the outer side surface of the annular portion. Preferably, the outer side surface of the annular portion has no longitudinal grooves.

Preferably the central hole extends through the nut member from end to end, and preferably the central hole is centered about the central longitudinal axis.

Also disclosed herein is the combination of a connector comprising a nut member having a driving head portion as described herein and a wrench adapted to engage the driving head portion of the nut member of the connector.

Also disclosed herein is the combination of a connector comprising a nut member having a driving head portion as described herein and a wrench having a fastener embracing surface generally complementary to at least a portion of the outer side surface of the driving head portion of the nut member of the connector. Preferably, the wrench is open-ended.

Also disclosed herein is the combination of a connector comprising a nut member having a driving head portion as described herein and a coaxial cable, wherein the connector is attached to an end of the cable.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
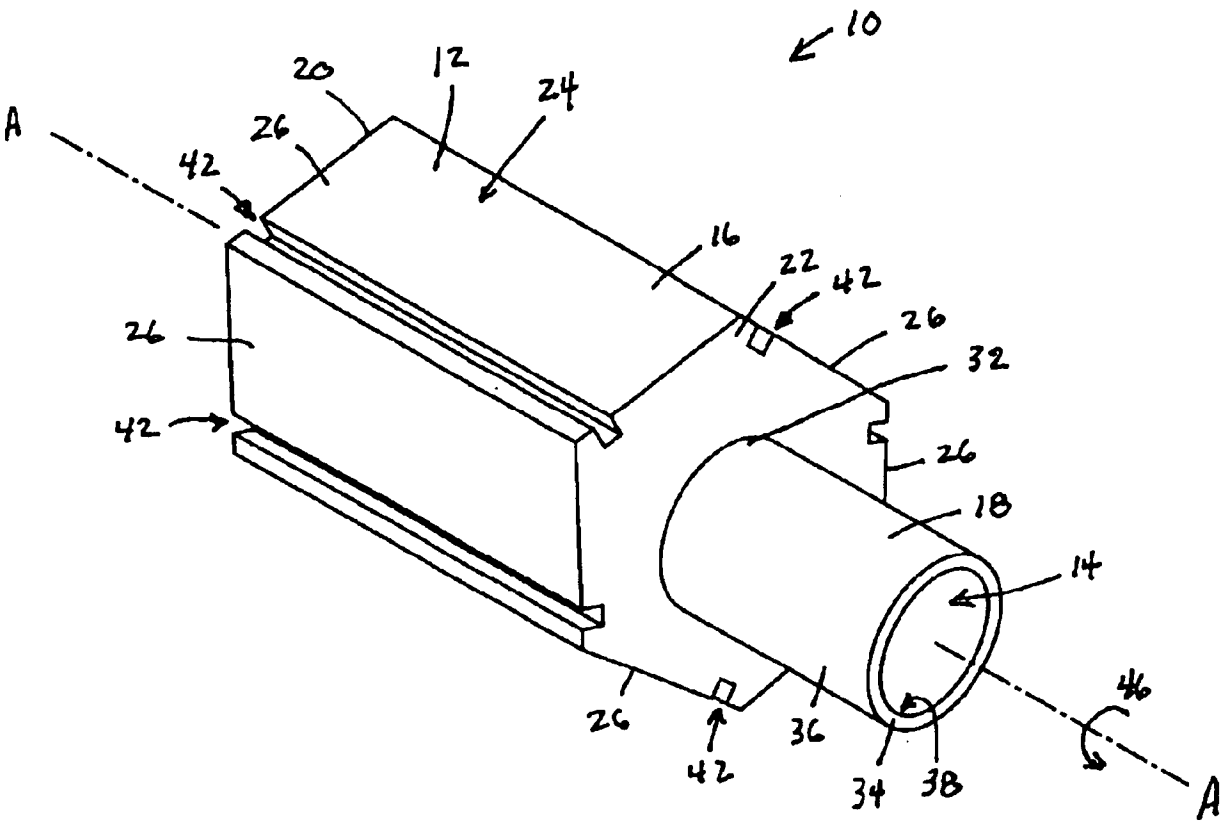
FIG. 1 is an isometric view of one preferred embodiment of a nut member as disclosed herein.

Reference will now be made in detail to the present preferred embodiment(s) of the invention, examples of which are illustrated in the accompanying drawings. Whenever possible, the same reference numerals will be used throughout the drawings to refer to the same or like parts. One embodiment of the nut member of the present invention is shown in FIG. 1, and is designated generally throughout by the reference numeral 10.

Figure 2:
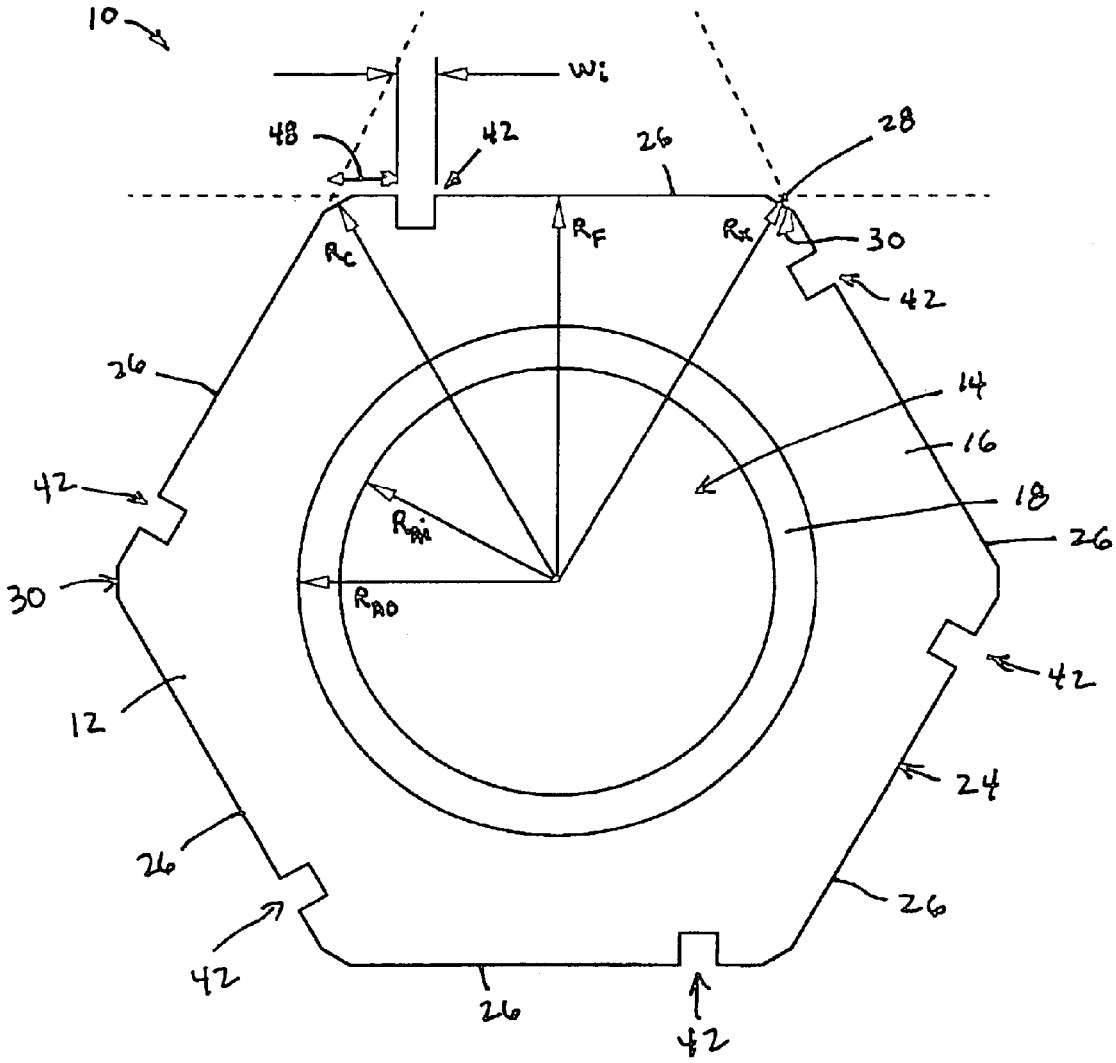
FIG. 2 is an end view of the nut member of FIG. 1.
Figure 3:
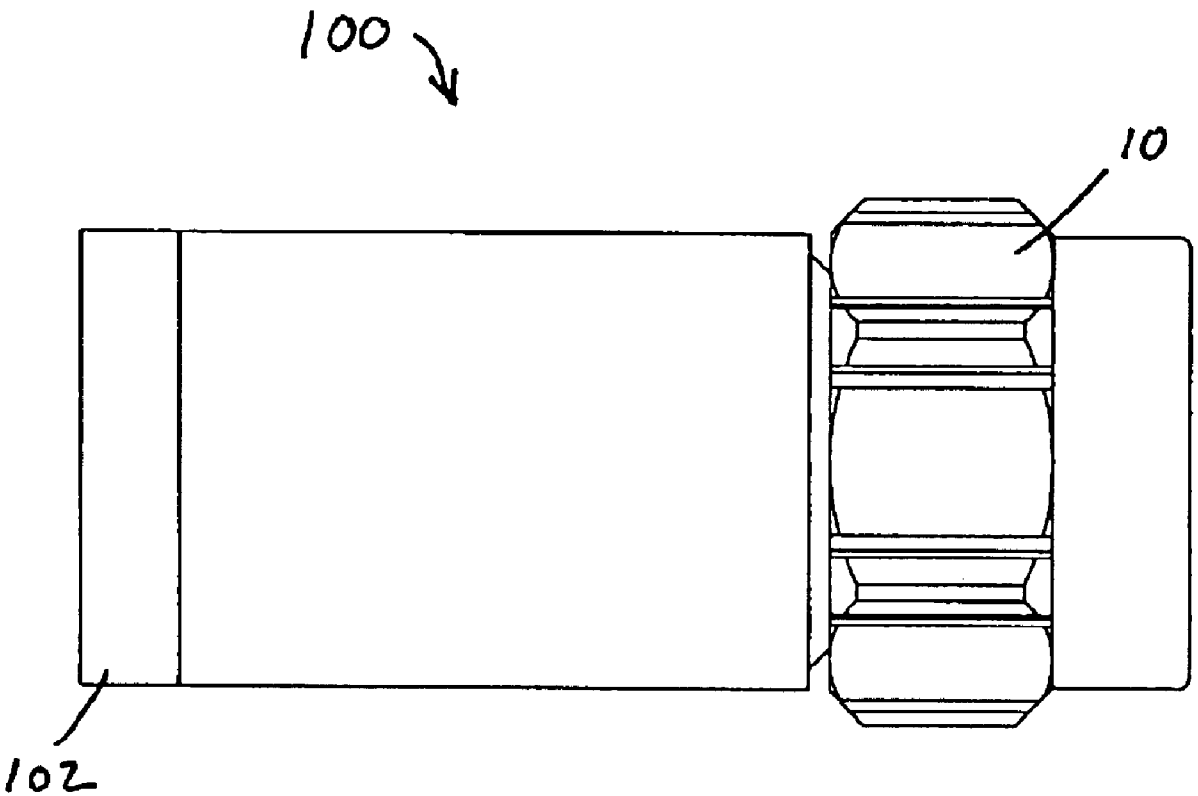
FIG. 3 is a side view of one preferred embodiment of a connector as disclosed herein.
Figure 4:
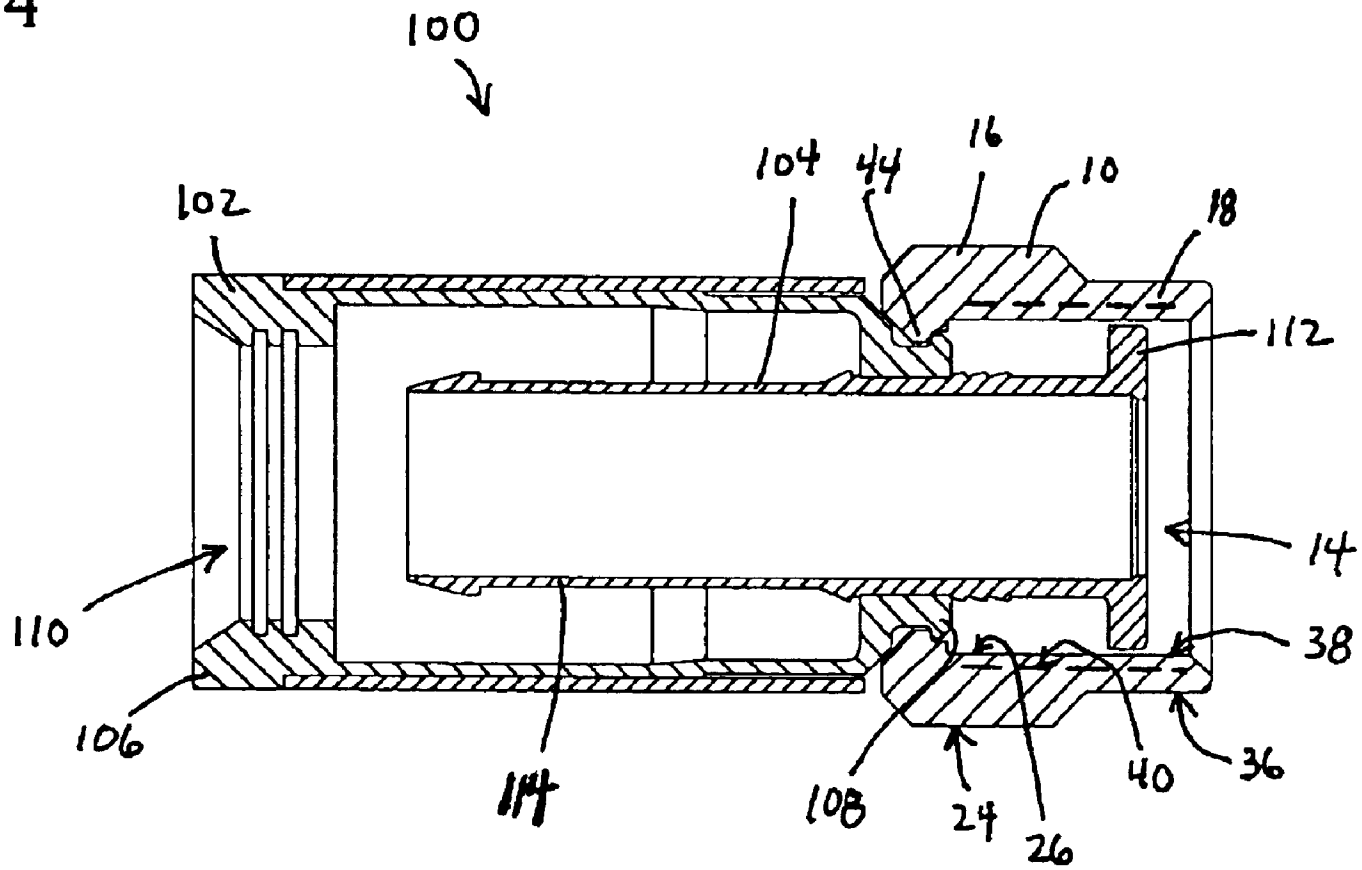
FIG. 4 is a side cutaway view along the centerline of the connector of FIG. 3 in a cable insertion state.
Figure 5:
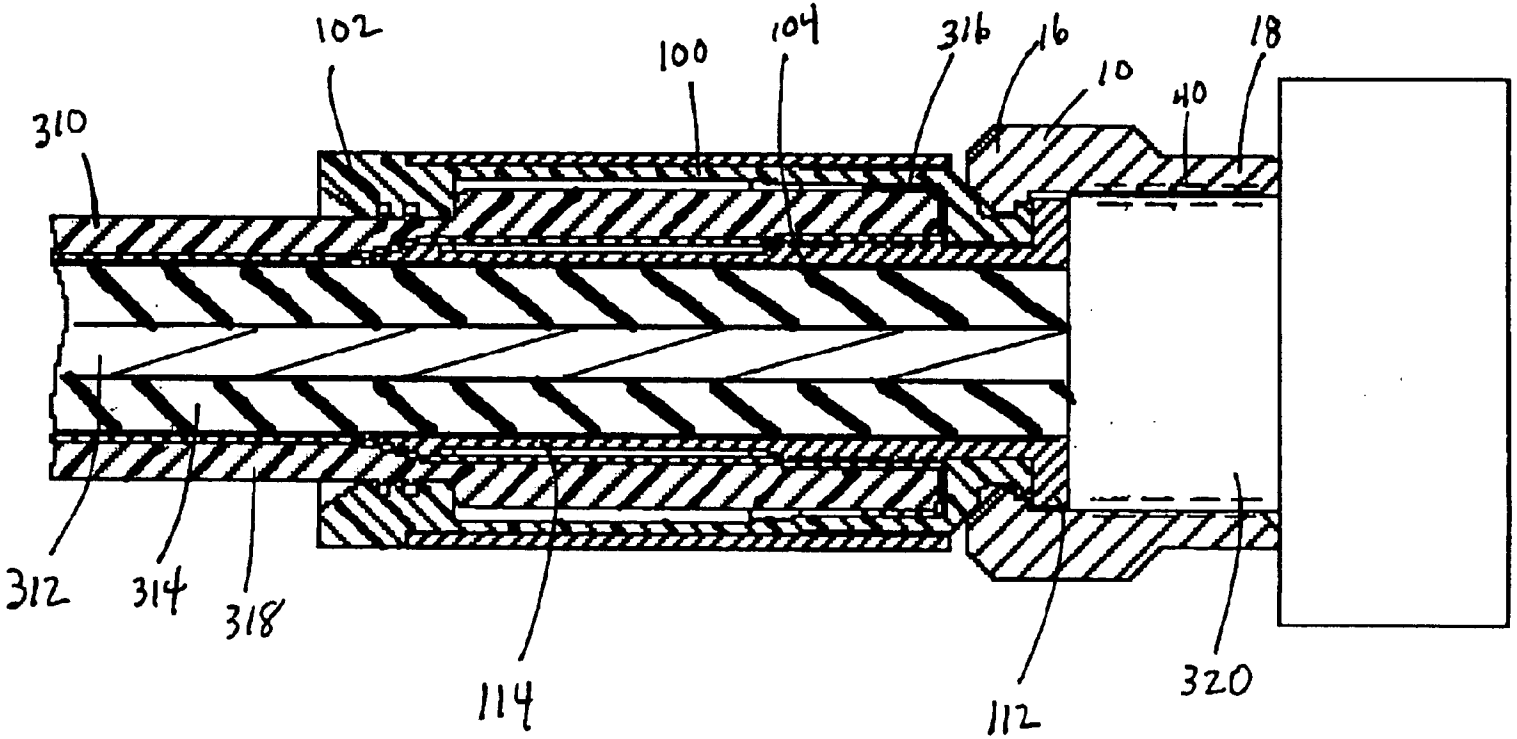
FIG. 5 is a side cutaway view along the centerline of the connector of FIG. 3 in a cable-installed state.

FIG. 1 schematically illustrates a perspective view of nut member 10 for a coaxial cable connector as disclosed herein. FIG. 2 schematically illustrates an end view of nut member 10. FIG. 3 shows a side view of an embodiment of a coaxial cable connector 100 as disclosed herein. FIG. 4 shows a side cutaway view of the connector of FIG. 3 in a cable insertion state. FIG. 5 shows a side cutaway view along the centerline of the connector of FIG. 3 in a cable-installed state, wherein the connector 100 connects a cable 310 to a threaded terminal 320. The cable 310 comprises a center conductor (typically metal) 312, a dielectric 314, a braid and/or foil 316, and jacket 318.

Referring to FIGS. 1–5, the nut member 10 comprises a nut body 12 having a central longitudinal axis A—A and a central hole 14. The nut body 12 comprises a driving head portion 16 and an annular portion 18.

The driving head portion 16 has a rear end 20, a front end 22, an outer side surface 24, and an inner side surface 26 extending from the rear end 20 to the front end 22. The inner side surface 26 (see FIG. 4) defines at least part of the central hole 14. The outer side surface 24 comprises a plurality of oppositely disposed flat sides 26 disposed substantially parallel, preferably parallel, with the central longitudinal axis. Each of the flat sides 26 lies in a respective plane, illustrated in FIG. 2 by dashed lines, disposed at least a minimum radial distance $R_F$ from the central longitudinal axis, wherein the planes of respective adjacent flat sides 26 intersect along respective apex lines 28, the apex lines being preferably parallel with the central longitudinal axis, disposed at a radial distance $R_X$ from the central longitudinal axis. Adjacent flat sides 26 intersect along corner edges 30 disposed at a maximum radial distance $R_C$ from the central longitudinal axis. The corner edges 30 may be sharp within manufacturing tolerances (i.e. $R_C$ is equal to $R_X$ within manufacturing tolerances), or preferably the corner edges 30 are rounded or shaped. Whether sharp or rounded or shaped, we have found that $(R_C-R_F)/(R_X-R_F)>0.75$ in order to promote adequate gripping of the nut member 10 by a wrench. For example, for values of $(R_C-R_F)/(R_X-R_F)$ less than 0.75 and using a wrench tool such as Gilbert Security Tool G-SST-US manufactured and distributed by Corning Gilbert Inc., we have found unacceptable ability to be wrench-tightened. For example, for $(R_C-R_F)/(R_X-R_F)$ of about 0.70, we found that the wrench tool jumped over the points with minor force, while for $(R_C-R_F)/(R_X-R_F)$ of about 0.63, the tool jumped over the points with ease. Lower values of $(R_C-R_F)(R_X-R_F)$ resulted in no nut/tool engagement. Other wrench tools could be used with the nut members disclosed herein.

The annular portion 18 has a rear end 32 disposed at the front end 22 of the driving head portion 16, a front end 34, an outer side surface 36 having a maximum radius $R_{AO}$ less than $R_F$ such that a minimum radial offset $(R_F-R_{AO})$ is provided between the outer side surface 24 of the driving head portion 16 and the outer side surface 36 of the annular portion 18, and an inner side surface 38 (see FIG. 4) extending from the rear end 32 of the annular portion 18 to the front end 34 of the annular portion 18, the inner side surface 38 of the annular portion 18 defining at least part of the central hole 14. Either the inner side surface 26 of the driving head portion 16, or the inner side surface 38 of the annular portion 18, or both, has threads 40 (see FIG. 4), i.e. the nut member 10 is internally threaded.

As illustrated by the embodiment in FIGS. 1 and 2, each of the flat sides 26 are grooved with a longitudinal groove 42 intermediate adjacent corner edges 30, each of the grooves 42 having a respective maximum width, $w_i$, and a respective maximum depth. Additional grooves may be provided on one or more of the flat sides 26. In some embodiments, one or more flat sides 26 are provided with no grooves.

Each grooved flat side 26 has a respective total groove width $\Sigma w_i$, wherein the respective maximum depth of each of the grooves is not greater than the radial offset between the outer side surfaces 24, 36 of the driving head portion 16 and the annular portion 18, that is, for any angular position in a transverse plane that intersects a respective groove 42. Thus, if a groove 42 were situated on a flat side 26 at the midpoint between adjacent corner edges 30, the radial offset would have a minimum value 42 (i.e. $R_F-R_{AO}$) compared to a groove situated closer to one of the corner edges 30. The depth of a groove 42 is its radial depth.

Preferably, none of the grooves 42 extends to the inner side surface 26 of the driving head portion 16 in order to promote environmental sealing between the inner side surface 26 and other surfaces provided by other parts of the connector to which the nut member 10 would become engaged.

In one preferred embodiment, the inner side surface 26 of the driving head portion 16 has threads. In another preferred embodiment, the inner side surface 26 of the annular portion 18 has threads. In yet another preferred embodiment, the inner side surfaces 26 of the driving head portion 16 and the inner side surface 38 of the annular portion 18 have threads.

The central hole 14 may have a substantially constant diameter or a variable diameter. In some preferred embodiments, the inner side surface 26 of the driving head portion 16 comprises a flange 44.

As seen in FIGS. 1 and 2, none of the grooves 42 has a maximum depth greater than the minimum radial offset ($R_F-R_{AO}$) between the outer side surfaces 24, 36 of the driving head portion 16 and the annular portion 18. The grooved flat sides 26 have a longitudinal groove 42 disposed between adjacent corner edges 30 and closer to the corner edge 30 in the direction of the threads, as indicated by the arrow 46 in FIG. 1. Upon tightening of the nut member 10 (or connector 100) onto a threaded terminal, torque can be preferentially applied to the part of the flat sides 26 having the longitudinal groove 42, whether the torque is provided by a wrench or by hand.

Each grooved flat side 26 has a transverse width $W_F$ and a total groove width $\Sigma w_i$.

In order to promote the ability to finger-tighten or hand-tighten the nut member 10 onto a threaded terminal, the ratio $\Sigma w_i/W_F$ is greater than 0.05, more preferably greater than 0.10, even more preferably greater than 0.15, for each of the grooved flat sides in order to allow finger or thumb or hand flesh to engage the depressions provided by the grooves 42. That is, a sufficient grooved surface area is required to provide adequate grip by the installer, in the event that a wrench is not utilized for tightening.

In order to help provide the strength of the nut member 10 under tightening via a tool such as a wrench, $\Sigma w_i/W_F$ is less than 1, preferably less than 0.9, more preferably less than 0.8. In preferred embodiments, $\Sigma w_i/W_F$ is between 0.05 and 1.0 for each of the grooved flat sides 26. In other preferred embodiments, each grooved flat side 26 has a transverse width $W_F$ and a total groove width, and the ratio $\Sigma w_i/W_F$ is between 0.10 and 0.9 for each of the grooved flat sides. In other preferred embodiments, each grooved flat side 26 has a transverse width $W_F$ and a total groove width, and the ratio $\Sigma w_i/W_F$ is between 0.15 and 0.8 for each of the grooved flat sides.

None of the grooves 42 has a maximum depth greater than the difference between the minimum radial distance $R_F$ from the central longitudinal axis and the maximum radius of the outer side surface 36 of the annular portion 18.

As seen in FIGS. 1 and 2, each of the grooves 42 are spaced away from the corner edges 30 by a linear distance 48 measured along the respective flat side 26 of at least 0.10 $W_F$, more preferably by at least 0.12 $W_F$, even more preferably by at least 0.14 $W_F$.

As illustrated in FIGS. 1 and 3 for that embodiment, the grooves 42 extend from the rear end 20 to the front end 22 of the driving head portion 16, and the grooves 42 extend continuously from the rear end 20 to the front end 22 of the driving head portion 16. In other embodiments, one or more grooves may be provided on a flat side 26, wherein the grooves longitudinally extend only partially between the rear end and the front end of the driving head portion 16. In other embodiments, a plurality of longitudinally aligned spaced apart grooves (e.g. at least two grooves being aligned end to end but separated by ungrooved surface) are disposed on a flat side 26. Multiple grooves of uniform or nonuniform length may be staggered over one or flat sides 26.

As seen in FIGS. 1, 2 and 3, none of the longitudinal grooves 42 extend onto the outer side surface 36 of the annular portion 18. Preferably, the outer side surface 36 of the annular portion 18 has no longitudinal grooves, whether extensions of grooves on the driving head portion 16 or otherwise, in order to promote environmental sealing between the outer side surface 36 of the annular portion 18 and a surface of another member used in conjunction with the connector, such as a protective boot.

The central hole 14 extends through the nut member 10 from end 20 to end 24, and the central hole 14 is centered about the central longitudinal axis A—A.

Figure 6:
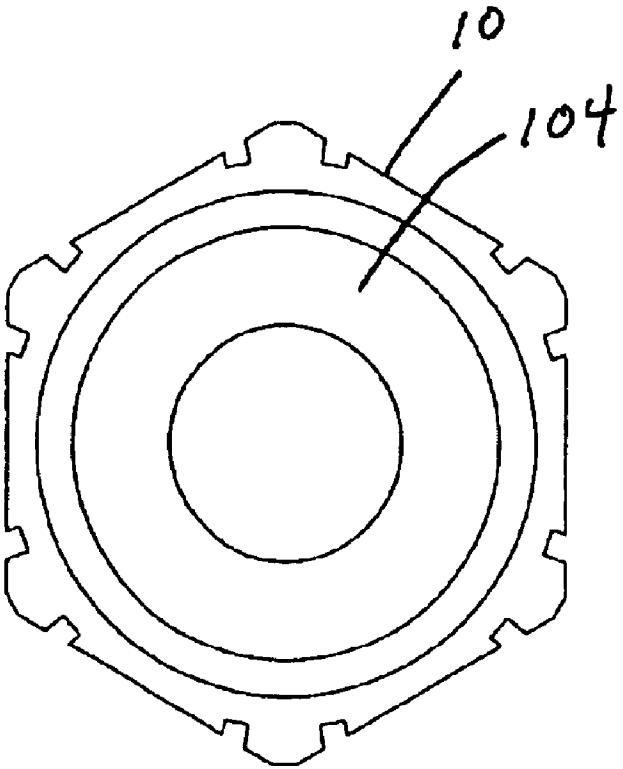
FIG. 6 is an end view of the connector of FIGS. 3–5.
Figure 7:
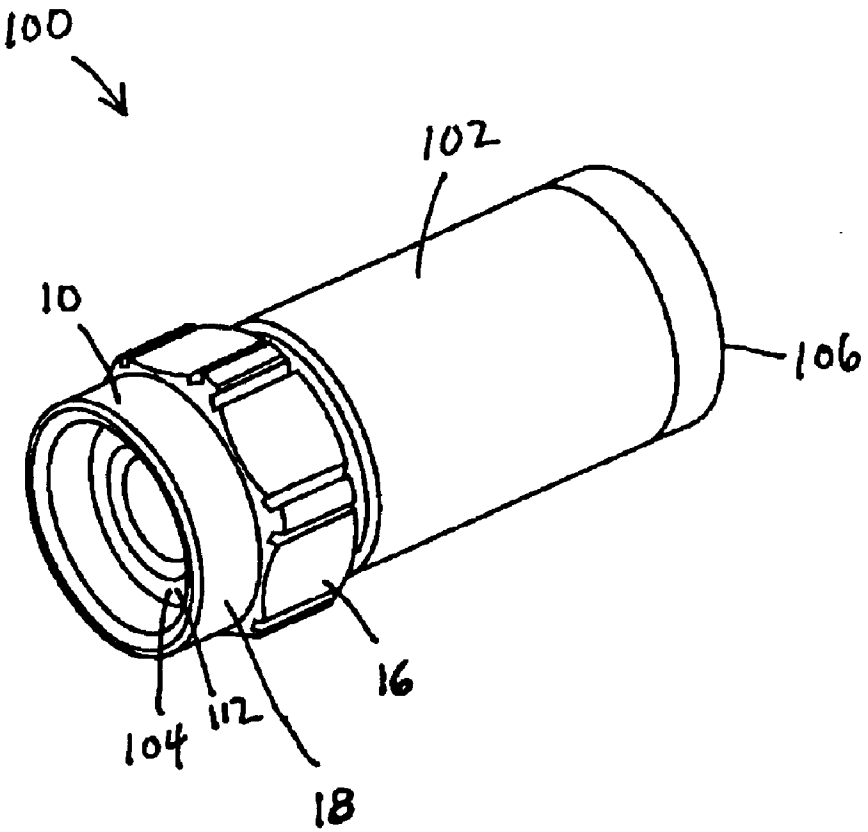
FIG. 7 is an isometric view of the connector of FIGS. 3–6.
Figure 8:
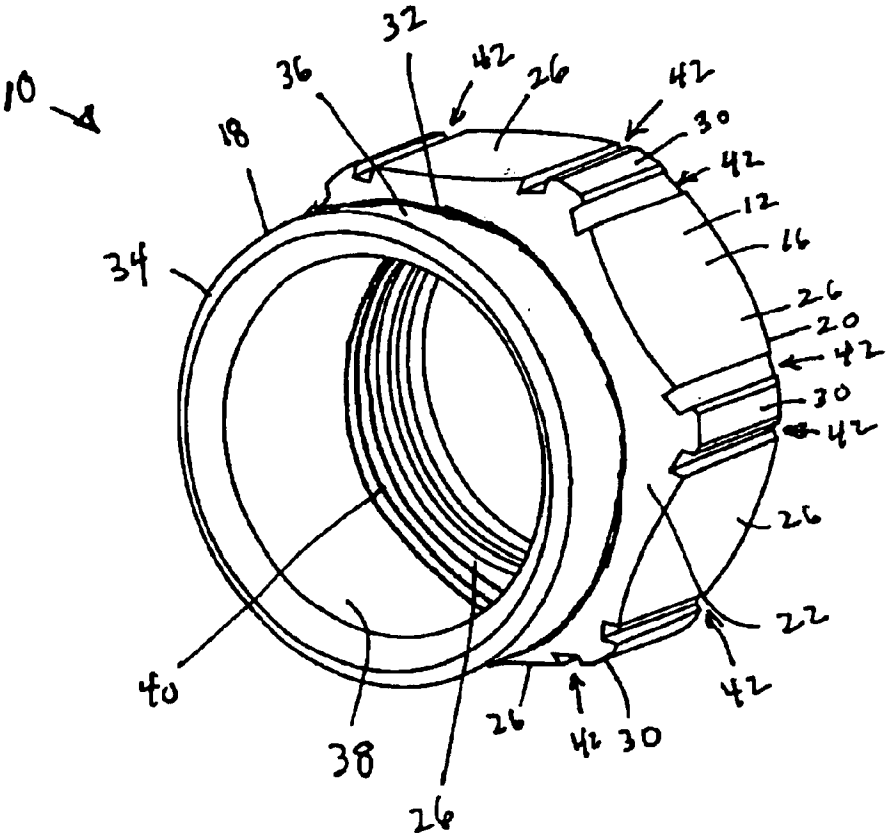
FIG. 8 is an isometric view of the nut member of the connector of FIGS. 3–6.

FIG. 6 is an end view of the connector 100 of FIGS. 3–5. FIG. 7 is an isometric view of the connector of FIGS. 3–6. FIG. 8 is an isometric view of the nut member of the connector of FIGS. 3–6. The connector 100 can be used for coupling an end of a coaxial cable to a threaded terminal. The connector 100 comprises a nut member 10, a cylindrical body member 102, and a post member 104. The cylindrical body member 102 has a rear end 106 (adapted to receive the end of the coaxial cable), a front end 108, and a central hole 110 extending through the cylindrical body from the rear end 106 to the front end 108. The nut member 10 has a central hole 110 extending through the nut member. The nut member 10 engages the front end 108 of the cylindrical body member 102. The post member 104 comprises a post flange 112 and a post shank 114. In both a cable insertion position (prior to securement of the connector 100 to the coaxial cable as illustrated in FIG. 4) and a cable-installed position (as illustrated in FIG. 5), the post member 104 is disposed at least partially within the central hole 110 of the cylindrical body member 102 at the front end 108 of the cylindrical body member 102 and disposed at least partially within the central hole 14 of the nut member 10. The post member 104 and the cylindrical body member 102 are movable with respect to each other in the cable-insertion position, wherein the post member 104 and the cylindrical body member 102 are adapted to sandwich a part of the coaxial cable in the cable-installed position. The nut member 10 comprises a nut body 12 having a central longitudinal axis A—A, the nut body 12 comprising: a driving head portion 16 having a rear end 20, a front end 22, an outer side surface 24, and an inner side surface 26 extending from the rear end 20 to the front end 22, the inner side surface 26 defining at least part of the central hole 14 of the nut member 10, the inner side surface 26 comprising an annular collar 44 for rotatably engaging the front end 108 of the cylindrical body member 102, the outer side surface 24 comprising a plurality of oppositely disposed flat sides 26 disposed substantially parallel, preferably parallel, with the central longitudinal axis A—A (the axis preferably being shared by the cylindrical body member 102, the post member 104, and the nut member 10), wherein each of the flat sides lies in a respective plane disposed at least a minimum radial distance $R_F$ from the central longitudinal axis, wherein the planes of respective adjacent flat sides 26 intersect along respective apex lines 28, preferably parallel with the central longitudinal axis, disposed at a maximum radial distance $R_X$ from the central longitudinal axis, wherein adjacent flat sides 26 intersect along corner edges 30 disposed at a maximum radial distance $R_C$ from the central longitudinal axis, wherein $(R_C-R_F)/(R_X-R_F)>0.75$, and an annular portion 18 having a rear end 32 disposed at the front end 22 of the driving head portion 16, a front end 34, an outer side surface 36 having a maximum radius less than $R_F$ such that a minimum radial offset is provided between the outer side surface 24 of the driving head portion 16 and the outer side surface 36 of the annular portion 18, and an inner side surface 38 extending from the rear end 32 of the annular portion 18 to the front end 34 of the annular portion 18, the inner side surface 38 of the annular portion 18 defining at least part of the central hole 14. In the embodiment shown in FIG. 4, both the inner side surface 26 of the driving head portion 16 and the inner side surface 38 of the annular portion 18 have threads 40 adapted to threadably engage the threaded terminal. Each of the flat sides 26 are grooved with two longitudinal grooves 42 intermediate adjacent corner edges 30, each of the grooves 42 having a respective maximum width, $w_i$, and a respective maximum depth, wherein each grooved flat side 26 has a respective total groove width $\Sigma w_i$, wherein the respective maximum depth of each of the grooves 42 is not greater than the radial offset between the outer side surfaces 24, 36 of the driving head portion 16 and the annular portion 18.

Figure 10:
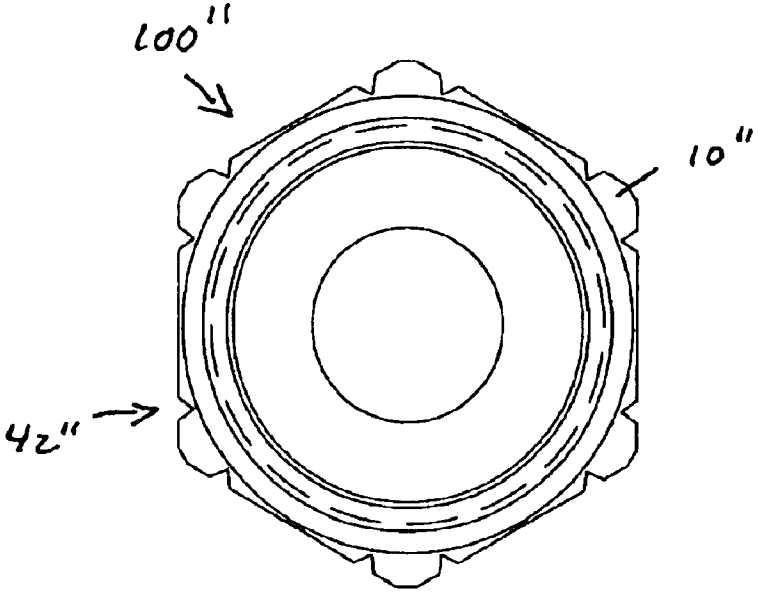
FIG. 10 is an end view of yet another preferred embodiment of a connector having yet another preferred embodiment of a nut member, as disclosed herein.
Figure 9:
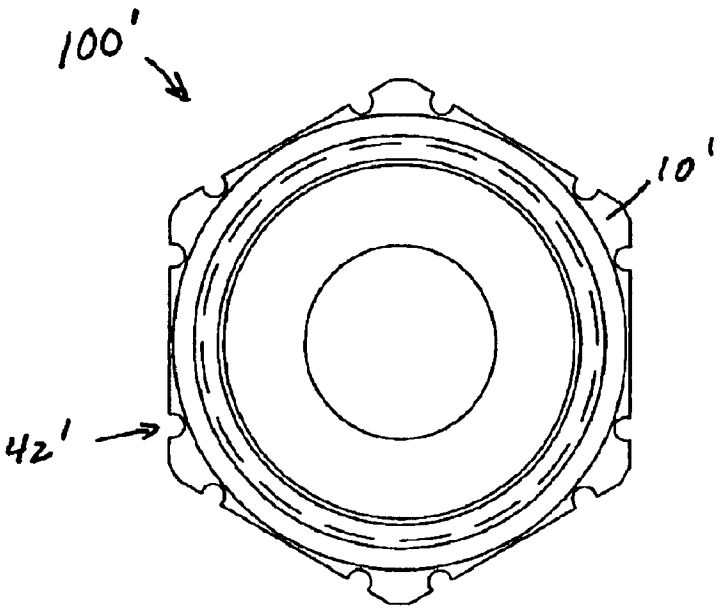
FIG. 9 is an end view of another preferred embodiment of a connector having another preferred embodiment of a nut member, as disclosed herein.

The grooves in FIG. 6 have a generally rectangular shape. FIG. 9 is an end view of a connector 100' as disclosed herein comprising a nut member 10' with rounded grooves 42'. FIG. 10 is an end view of a connector 100" as disclosed herein comprising a nut member 10" with V-shaped grooves 42".

The nut member disclosed herein may be adapted to various types of coaxial connectors, such as F-type, SMA, ENC, SC and other connectors.

Figure 11:
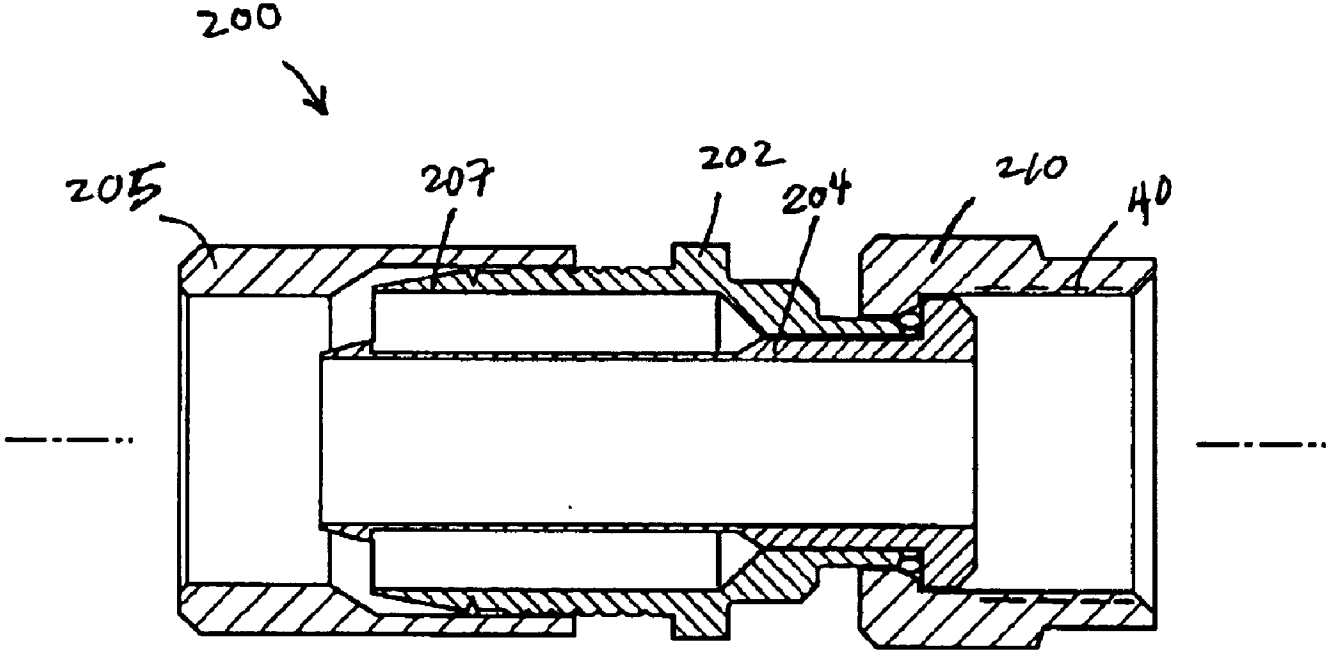
FIG. 11 shows a side view of still another embodiment of a coaxial cable connector as disclosed herein.

FIG. 11 shows a side view of another embodiment of a coaxial cable connector 200 as disclosed herein. The connector 200 comprises a cylindrical body 202, a post member 204, a nut member 210 as disclosed herein, and a compression ring 205. Axial movement of the cylindrical body 202 and the compression ring 205 toward each other causes the cylindrical sleeve 207 to compress radially inwardly to sandwich the jacket of a coaxial cable between the post member 204 and the cylindrical sleeve 207.

Figure 12:
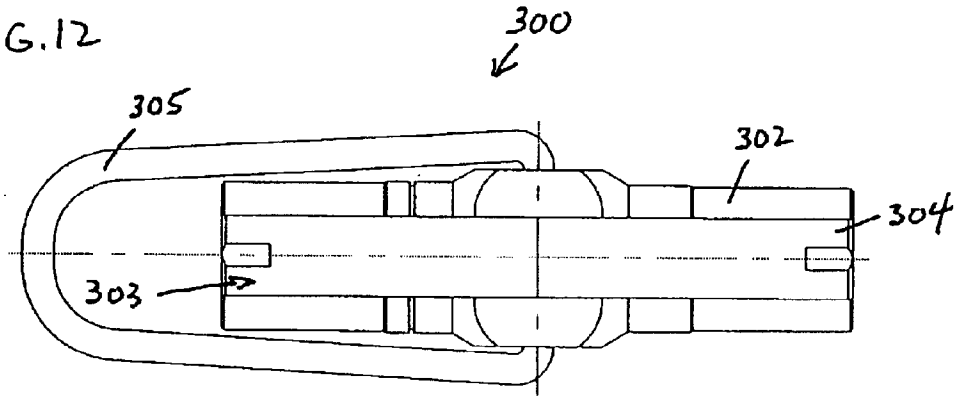
FIG. 12 shows a side view of a representative tool suitable for tightening coaxial cable connectors, and nut members, as disclosed herein.
Figure 13:
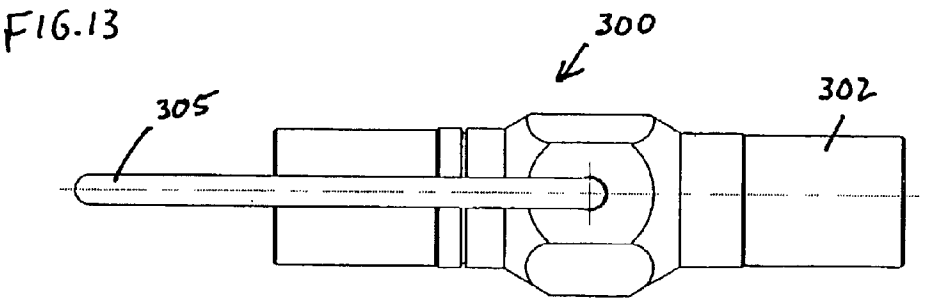
FIG. 13 is a side view of the tool of FIG. 12.
Figure 14:
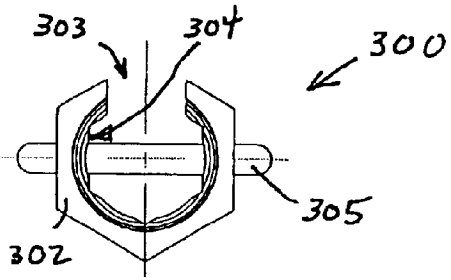
FIG. 14 is an end view of the tool 300 of FIGS. 12–13.

FIG. 12 shows a top view of a representative wrench tool 300 such as the Gilbert Security Tool G-SST-US, manufactured and distributed by Corning Gilbert Inc., which is a wrench tool 300 suitable for use with coaxial cable connectors having nut members. FIG. 13 is a side view of the tool 300 of FIG. 12. FIG. 14 is an end view of the tool 300 of FIGS. 12–13. Tool 300 comprises a generally C-shaped body 302 provided with an axial slot 303 and an inner fastener embracing surface 304 disposed at one end, wherein the inner surface 304 has a contour which mates with a nut member. The slot 303 is adapted to permit the tool 300 to be slid over a coaxial cable 310 such that the tool 300 and the cable 310 can be oriented with parallel longitudinal axes. The tool 300 can be used to tighten to a terminal 320, or loosen from a terminal, a nut member which forms part of a connector attached to the end of the cable 310. Preferably the tool 300 comprises contoured inner fastener embracing surfaces 304 at both opposing ends, as illustrated in FIG. 12. The tool 300 also comprises a handle 305 which is preferably pivotally attached to the C-shaped body 304.

Figure 15:
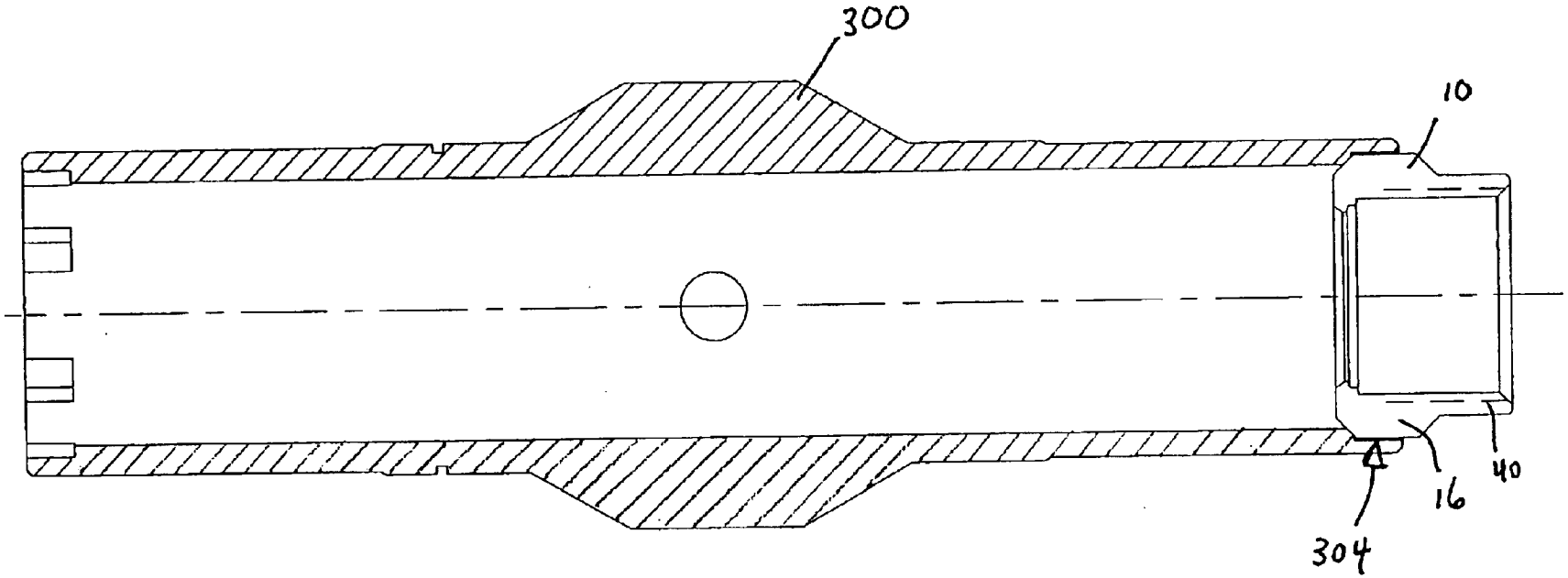
FIG. 15 is a cutaway cross-sectional side view of the tool 300 of FIG. 12 (handle not shown) in engagement with a nut member, as disclosed herein.

FIG. 15 is a cutaway cross-sectional side view of the tool 300 of FIG. 12 (handle not shown) in engagement with a nut member 10, as disclosed herein. The wrench tool 300 is shown engaging the driving head portion 16 of a nut member 10 of a connector disclosed herein. The wrench 300 is open-ended and has a fastener embracing surface 304 generally complementary to at least a portion of the outer side surface of the driving head portion 16 of the nut member 10.

Figure 16:
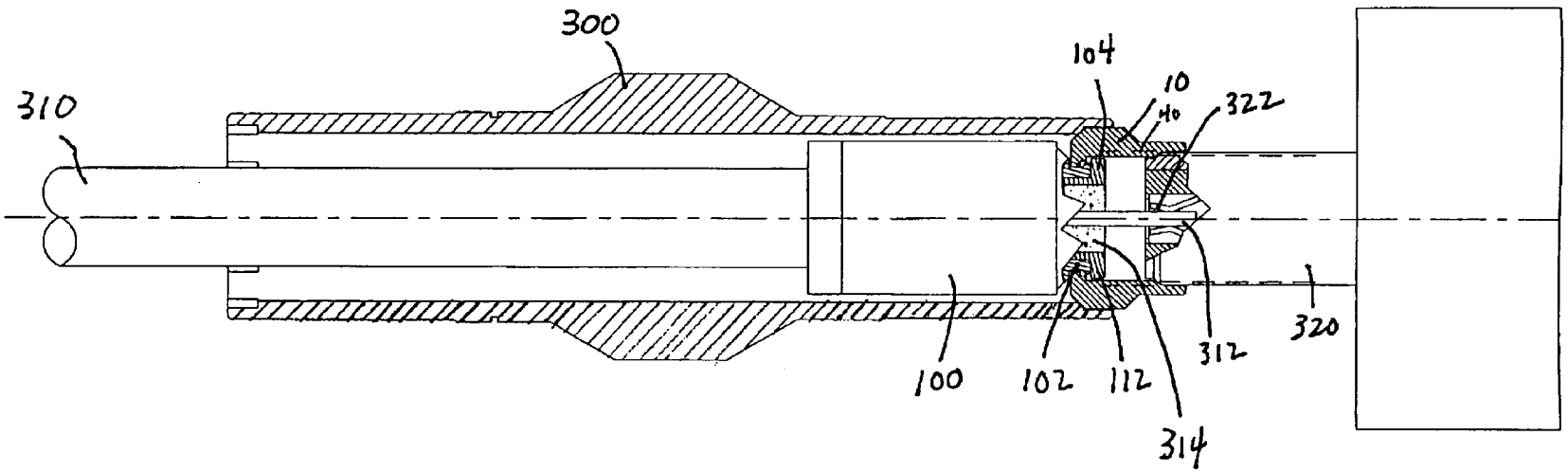
FIG. 16 is a cutaway cross-sectional side view of the tool 300 of FIG. 12 (handle not shown) in engagement with a connector, wherein the connector comprises a nut member shown engaging a terminal and wherein the connector is attached to the end of a coaxial cable, as disclosed herein, wherein the connector and the terminal are shown in partial cutaway cross-section.

FIG. 16 is a cutaway cross-sectional side view of the tool 300 of FIG. 12 (handle not shown) in engagement with a connector 100, wherein the connector 100 comprises a nut member 10 shown engaging a terminal 320 and the connector 100 is attached to the end of a coaxial cable 310, as disclosed herein. The connector 100 and the terminal 320 are shown in partial cutaway cross-section. A portion of the connector 100 and a portion of the cable 310 are shown disposed within the tool 300. The nut member 10 may thus be tightened onto the terminal 320, thereby attaching the connector 100 to the terminal 320, thereby establishing a physical and electrical contact between the cable 310 and the terminal 320. The tool 300 may also be used to loosen the nut member 10 from the terminal 320, thereby disengaging the connector 100 from the terminal 320, thereby disconnecting the cable 310 from the terminal 320.

Figure 17:
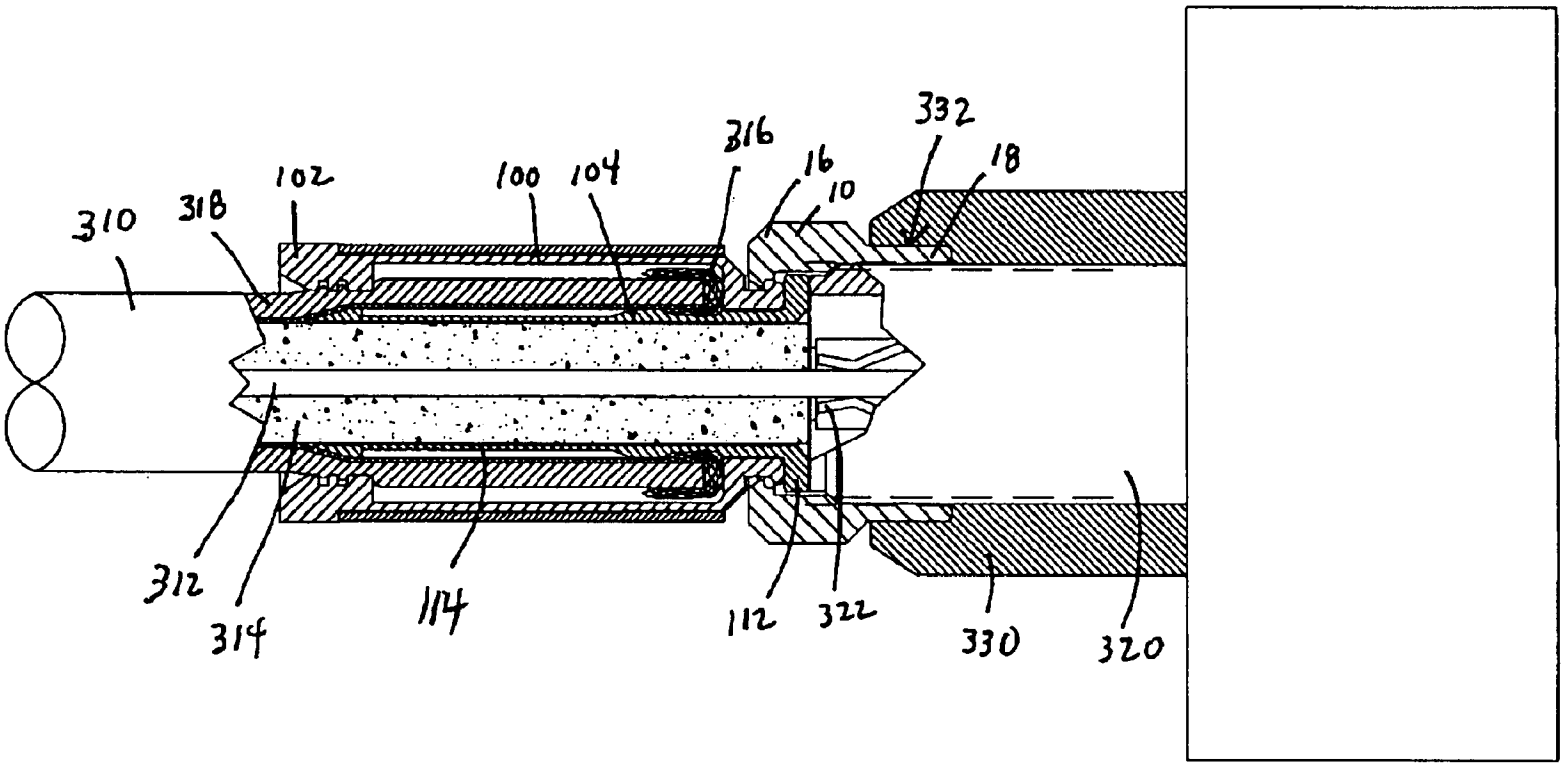
FIG. 17 is a side cutaway view along the centerline of a connector with a nut member connecting a coaxial cable to a terminal and covered by a seal ring, or boot, as disclosed herein.

FIG. 17 shows a side cutaway view along the centerline of a connector 100 with a nut member 10 connecting a coaxial cable 310 to a terminal 320 and covered by a seal ring, or boot, 330, as disclosed herein. The coaxial cable 310 comprises a center conductor 312 surrounded by a dielectric 314, which is surrounded by an outer conductor such as a foil and/or braid 316, all of which is encased in a jacket 318. The connector 100 is attached to the cable 310 in a cable-installed state wherein the outer conductor 316 and the jacket 318 are sandwiched between the cylindrical body member 102 and the shank 114 of the post member 104, wherein the shank 114 has been driven between the dielectric 314 and the outer conductor 316. The nut member 10 has been threaded onto the terminal 320, which was surrounded by a seal ring or boot 330, and tightened. The interface 332 between abutting surfaces of the seal ring 330 and the annular portion 18 of the nut member 10 forms an environmental seal. Preferably, a seal is established around an entire circumference of the annular portion 18, for example to prevent moisture from entering the connector 100 and/or terminal 320. The terminal 320 shown in FIG. 17 comprises prongs 322 which grip the center conductor 312 of cable 310 to establish a physical and electrical connection.

The driving head portion 16 of the nut member 10 disclosed herein preferably has a polygonal periphery, for example the hexagonal periphery shown in FIGS. 6–10. Other embodiments include square, quadrilateral, octagonal, and other shaped peripheries. Preferably the periphery is in the shape of a regular polygon, more preferably a regular hexagon.

The nut member 10 may be made by any known process. Preferably the grooves on the nut member are formed by a die during extrusion. Preferably no machining of the nut member 10 is performed. In some preferred embodiments, the nut member 10 is made from metal. In other preferred embodiments, the nut member 10 is made from plastic.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A nut member for a coaxial cable connector, the nut member comprising a nut body having a central longitudinal axis and a central hole, the nut body comprising:

a driving head portion having a rear end, a front end, an outer side surface, and an inner side surface extending from the rear end to the front end, the inner side surface defining at least part of the central hole, the outer side surface comprising a plurality of oppositely disposed flat sides disposed substantially parallel with the central longitudinal axis, wherein each of the flat sides lies in a respective plane disposed at least a minimum radial distance $R_F$ from the central longitudinal axis, wherein the planes of respective adjacent flat sides intersect along respective apex lines disposed at a radial distance $R_X$ from the central longitudinal axis, wherein adjacent flat sides intersect along corner edges disposed at a radial distance $R_C$ from the central longitudinal axis, wherein $(R_C-R_F)/(R_X-R_F)>0.75$; and an annular portion having a rear end disposed at the front end of the driving bead portion, a front end, an outer side surface having a maximum radius less than $R_F$ such that a minimum radial offset is provided between the outer side surface of the driving head portion and the outer side surface of the annular portion, and an inner side surface extending from the rear end of the annular portion to the front end of the annular portion, the inner side surface of the annular portion defining at least part of the central hole;

wherein at least one of the inner side surface of the driving head portion and the inner side surface of the annular portion has threads;

wherein at least two of the flat sides are grooved with at least one longitudinal groove, each of the grooves having a respective maximum width, $w_i$, and a respective maximum depth, wherein each grooved flat side has a respective total groove width $\Sigma w_i$, wherein the respective maximum depth of each of the grooves is not greater than the radial offset between the outer side surfaces of the driving head portion and the annular portion.

2. The nut member of claim 1 wherein none of the grooves has a maximum depth greater than the minimum radial offset between the outer side surfaces of the driving head portion and the annular portion.

3. The nut member of claim 1 wherein the grooved flat sides have a longitudinal groove disposed between adjacent corner edges and closer to the corner edge in the direction of the threads.

4. The nut member of claim 1 wherein the grooved flat sides have a longitudinal groove disposed between adjacent corner edges and closer to the corner edge upon which torque is applied when tightening the nut.

5. The nut member of claim 1 wherein each grooved flat side has a transverse width $W_F$ and a total groove width, and the ratio $\Sigma w_i/W_F>0.05$ for each of the grooved flat sides.

6. The nut member of claim 1 wherein each grooved flat side has a transverse width $W_F$ and a total groove width, and the ratio $\Sigma w_i/W_F>0.10$ for each of the grooved flat sides.

7. The nut member of claim 1 wherein each grooved flat side has a transverse width $W_F$ and a total groove width, and the ratio $\Sigma w_i/W_F>0.15$ for each of the grooved flat sides.

8. The nut member of claim 1 wherein each grooved flat side has a transverse width $W_F$ and a total groove width, and the ratio $\Sigma w_i/W_F$ is between 0.05 and 1.0 for each of the grooved flat sides.

9. The nut member of claim 1 wherein each grooved flat side has a transverse width $W_F$ and a total groove width, and the ratio $\Sigma w_i/W_F$ is between 0.10 and 0.9 for each of the grooved flat sides.

10. The nut member of claim 1 wherein each grooved flat side has a transverse width $W_F$ and a total groove width, and the ratio $\Sigma w_i/W_F$ is between 0.15 and 0.8 for each of the grooved flat sides.

11. The nut member of claim 1 wherein none of the grooves has a maximum depth greater than the difference between the minimum radial distance $R_F$ from the central longitudinal axis and the maximum radius of the outer side surface of the annular portion.

12. The nut member of claim 1 wherein the flats have a transverse width $W_F$, and wherein all of the grooves are spaced away from the corner edges by at least 0.10 $W_F$.

13. The nut member of claim 1 wherein the flats have a transverse width $W_F$, and wherein all of the grooves are spaced away from the corner edges by at least 0.14 $W_F$.

14. The nut member of claim 1 wherein a majority of the flat sides are grooved with at least one longitudinal groove.

15. The nut member of claim 1 wherein all of the flat sides are grooved with at least one longitudinal groove.

16. The nut member of claim 1 wherein all of the flat sides are grooved with at least two longitudinal grooves.

17. The nut member of claim 1 wherein none of the longitudinal grooves extend onto the outer side surface of the annular portion.

18. The nut member of claim 1 wherein the outer side surface of the annular portion has no longitudinal grooves.

19. The nut member of claim 1 wherein none of the grooves extend to the inner side surface of the driving head portion.

20. The nut member of claim 1 wherein the central hole has varying diameter.

21. The nut member of claim 1 wherein the inner side surface of the driving head portion comprises a flange the central hole.

22. The nut member of claim 1 wherein the grooves extend from the rear end to the front end of the driving head portion.

23. The nut member of claim 1 wherein the grooves extend continuously from the rear end to the front end of the driving head portion.

24. A coaxial cable connector comprising the nut member of claim 1.

25. A nut member for a coaxial cable connector, the nut member comprising a nut body having a central longitudinal axis and a central hole, the nut body comprising:

a driving head portion having a rear end, a front end, an outer side surface, and an inner side surface extending from the rear end to the front end, the inner side surface defining at least part of the central hole, the outer side surface comprising a plurality of oppositely disposed flat sides disposed substantially parallel with the central longitudinal axis, wherein each of the flat sides lies in a respective plane disposed at least a minimum radial distance $R_F$ from the central longitudinal axis, wherein the planes of respective adjacent flat sides intersect along respective apex lines disposed at a radial distance $R_X$ from the central longitudinal axis, wherein adjacent flat sides intersect along corner edges disposed at a radial distance $R_C$ from the central longitudinal axis, wherein $(R_C-R_F)/(R_X-R_F)>0.75$; and an annular portion having a rear end disposed at the front end of the driving head portion, a front end, an outer side surface having a maximum radius less than $R_F$ such that a minimum radial offset is provided between the outer side surface of the driving head portion and the outer side surface of the annular portion, and an inner side surface extending from the rear end of the annular portion to the front end of the annular portion, the inner side surface of the annular portion defining at least part of the central hole;

wherein at least one of the inner side surface of the driving head portion and the inner side surface of the annular portion has threads;

wherein each of the flat sides is grooved with at least one longitudinal groove, each of the grooves having a respective maximum width, $w_i$, and a respective maximum depth, wherein each grooved flat side has a respective total groove width $\Sigma w_i$, wherein the respective maximum depth of each of the grooves is not greater than the radial offset between the outer side surfaces of the driving head portion and the annular portion.

26. The nut member of claim 25 wherein each of the flat sides is grooved with at least two longitudinal grooves.

27. A connector for coupling an end of a coaxial cable to a threaded terminal, the connector comprising:

a cylindrical body member having a rear end adapted to receive the end of the coaxial cable, a front end, and a central hole extending through the cylindrical body from the rear end to the front end;

a nut member having a central hole extending through the nut member, wherein the nut member engages the front end of the cylindrical body member; and a post member comprising a post flange and a post shank, the post member disposed at least partially within the central hole of the cylindrical body member at the front end of the cylindrical body member and disposed at least partially within the central hole of the nut member, wherein the post member and the cylindrical body member are movable with respect to each other in a cable-insertion position, wherein the post member and the cylindrical body member are adapted to sandwich a part of the coaxial cable in a cable-installed position;

wherein the nut member comprises a nut body having a central longitudinal axis, the nut body comprising:

a driving head portion having a rear end, a front end, an outer side surface, and an inner side surface extending from the rear end to the front end, the inner side surface defining at least part of the central hole of the nut member, the inner side surface comprising an annular collar for rotatably engaging the front end of the cylindrical body member, the outer side surface comprising a plurality of oppositely disposed flat sides disposed substantially parallel with the central longitudinal axis, wherein each of the flat sides lies in a respective plane disposed at least a minimum radial distance $R_F$ from the central longitudinal axis, wherein the planes of respective adjacent flat sides intersect along respective apex lines disposed at a radial distance $R_X$ from the central longitudinal axis, wherein adjacent flat sides intersect along corner edges disposed at a radial distance $R_C$ from the central longitudinal axis, wherein $(R_C-R_F)/(R_X-R_F)>0.75$; and an annular portion having a rear end disposed at the front end of the driving head portion, a front end, an outer side surface having a maximum radius less than $R_F$ such that a minimum radial offset is provided between the outer side surface of the driving head portion and the outer side surface of the annular portion, and an inner side surface extending from the rear end of the annular portion to the front end of the annular portion, the inner side surface of the annular portion defining at least part of the central hole;

wherein at least one of the inner side surface of the driving head portion and the inner side surface of the annular portion has threads adapted to threadably engage the threaded terminal;

wherein at least two of the flat sides are grooved with at least one longitudinal groove, each of the grooves having a respective maximum width, $w_i$, and a respective maximum depth, wherein each grooved flat side has a respective total groove width $\Sigma w_i$, wherein the respective maximum depth of each of the grooves is not greater than the radial offset between the outer side surfaces of the driving head portion and the annular portion.

28. In combination the connector of claim 27 and a wrench adapted to engage the driving head portion of the nut member of the connector.

29. In combination the connector of claim 27 and a wrench having a fastener embracing surface generally complementary to at least a portion of the outer side surface of the driving head portion of the nut member of the connector.

30. The combination of claim 29 wherein the wrench is open-ended.

31. In combination the connector of claim 27 and a coaxial cable, wherein the connector is attached to an end of the cable.

* * * * *